US007988500B2

(12) United States Patent
Furukawa et al.

(10) Patent No.: US 7,988,500 B2
(45) Date of Patent: Aug. 2, 2011

(54) SOCKET AND CONTACT HAVING ANCHORS

(75) Inventors: Hideharu Furukawa, Norton, MA (US); Haruhiko Endoh, Oyama-cho (JP)

(73) Assignee: Sensata Technologies Massachusetts, Inc., Attleboro, MA (US)

( * ) Notice: Subject to any disclaimer, the term of this patent is extended or adjusted under 35 U.S.C. 154(b) by 0 days.

(21) Appl. No.: 12/639,183

(22) Filed: Dec. 16, 2009

(65) Prior Publication Data

US 2011/0143559 A1 Jun. 16, 2011

(51) Int. Cl.
*H01R 13/40* (2006.01)

(52) U.S. Cl. ..... 439/733.1; 439/66; 439/83

(58) Field of Classification Search ..... 439/733.1, 439/66, 83, 70, 869, 444
See application file for complete search history.

(56) References Cited

U.S. PATENT DOCUMENTS

| | | | | | |
|---|---|---|---|---|---|
| 3,412,369 | A * | 11/1968 | Fox | 439/748 |
| 3,621,444 | A * | 11/1971 | Stein | 439/109 |
| 4,007,977 | A * | 2/1977 | Bauerle | 439/686 |
| 5,549,480 | A * | 8/1996 | Cheng | 439/79 |
| 6,027,355 | A * | 2/2000 | Ikeya | 439/268 |
| 6,074,233 | A * | 6/2000 | Lin | 439/342 |
| 6,109,981 | A * | 8/2000 | Jin-ichi et al. | 439/733.1 |
| 6,171,126 | B1 * | 1/2001 | Wu et al. | 439/224 |
| 6,287,127 | B1 | 9/2001 | Hibino et al. | |
| 6,312,276 | B1 * | 11/2001 | Lin | 439/342 |
| 6,315,615 | B1 * | 11/2001 | Raistrick | 439/637 |
| 6,439,934 | B1 * | 8/2002 | Yu | 439/733.1 |
| 6,475,042 | B1 * | 11/2002 | Yu | 439/857 |
| 6,634,911 | B1 * | 10/2003 | Billman et al. | 439/884 |
| 6,672,886 | B2 * | 1/2004 | Billman | 439/82 |
| 6,700,800 | B2 * | 3/2004 | Combs et al. | 361/825 |
| 7,021,975 | B2 * | 4/2006 | Lappohn | 439/733.1 |
| 7,044,805 | B1 * | 5/2006 | Huang | 439/676 |
| 7,361,044 | B1 * | 4/2008 | Pandey et al. | 439/342 |
| 7,674,125 | B2 * | 3/2010 | Chien et al. | 439/342 |
| 7,744,431 | B2 * | 6/2010 | Trout et al. | 439/733.1 |
| 2004/0229519 | A1 * | 11/2004 | Lappohn | 439/733.1 |

* cited by examiner

*Primary Examiner* — T C Patel
*Assistant Examiner* — Harshad C Patel
(74) *Attorney, Agent, or Firm* — Russell E. Baumann

(57) ABSTRACT

A socket apparatus comprises a base portion defining an array of contact cavities. A plurality of contacts are inserted into the array of contact cavities defined in the base portion. The base portion includes a top side and a bottom side and a plurality of ribs extending from the bottom side. Each rib defines at least one sidewall that engages with an anchor of a contact to securely mount the contact. Each contact includes a mounting portion having a first anchor and a second anchor extending from the mounting portion and operable to engage a mounting surface of the base portion to securely mount the contact. The first anchor provides a first anchor force for the contact to the base portion that is substantially greater than a second anchor force provided by the second anchor to the base portion.

18 Claims, 12 Drawing Sheets

SOCKET AND CONTACT HAVING ANCHORS

FIELD OF THE INVENTION

This invention relates generally to sockets and contacts that mount a semiconductor or chip device and more particularly to a socket and contacts that provide an electrical connection between the semiconductor device and a circuit substrate.

BACKGROUND OF THE INVENTION

In the electronics industry, manufacturers of semiconductor devices such as integrated circuits (IC) produce devices in a form of packages or IC chips that contain semiconductor circuitry capable of numerous electronic processing and computation tasks. During manufacturing and testing of such IC chips, the chips are subject a variety of tests such as burn-in tests and electrical property tests to ensure the chips operate properly from a quality and performance perspective prior to shipping to customers. While undergoing such tests, the IC chips are typically not permanently soldered to IC chip testing equipment. Rather, such chips are placed into a test socket apparatus which can temporarily yet firmly hold the chips as the tests are performed. The sockets also allow a chip mounted in a socket to be transferred from one test station to another without requiring the chip itself to be inserted and removed from the socket, thus resulting in less wear and tear on the physical IC chip.

A typical IC chip has a large number of electrical leads that extend from one or more surfaces of the chip. Depending upon the specific chip or package configuration, the electrical leads of an IC chip may be pins, leads, terminals or balls or another type of connector that are often arranged in a matrix, array or other uniform layout. Conventional test sockets typically grasp the electrical leads, pins, balls or connectors of a chip undergoing testing using respective contacts for each lead. As an example, a Ball Grid Array (BGA) package is a type of physical IC chip configuration that includes small solder balls that extend downwards from a lower surface of the chip. Each ball serves as an electrical input/output path to circuitry contained within the IC chip.

Issued U.S. Pat. Nos. 6,027,355 and 6,287,127, owned by assignee of this instant application, describe a socket apparatus designed to hold a BGA package during testing. The entire teachings and contents of these referenced issued patents are hereby incorporated by reference in their entirety. The socket apparatus described in the aforementioned patents provide a main socket body for removably loading an electric part such as an IC chip that has an arrangement or array of lead terminals in a prescribed pattern that get inserted into the socket. The socket includes an array of contact makers, arms or fingers arranged on the main socket body in conformity with the pattern of terminal leads of the chip. Each contact maker or contact has a pair of openable and closeable arm-shaped contacts or fingers capable of flexibly opening and closing in compressive engagement holding each respective terminal lead of the electric part. The socket provides a sliding mechanism that uniformly causes the arms of each contact top to open in unison as the IC chip is lowered into the socket, thus providing a zero insertion force (ZIF) socket that does not strain the contacts of the chip during insertion (and during removal) of the chip into and out of the socket.

When the chip is in place, the arms are released and each set of arms provides compressive force on a respective contact (e.g. ball or lead from the chip) to make a proper electrical connection. At this time, the terminal leads of the electrical part are firmly sandwiched by the respective arm-shaped contacts as a result of the face to face relation of the pressure contacts of the arm-shaped contact thereby obtaining a state of satisfactory electrical connection. After testing is complete, just prior to chip removal from the socket, the sliding mechanism is engaged to again uniformly open the arms of each contact to provide for no force exerted on the leads of the chip as it is removed from the socket. In this manner, the socket apparatus can be used to receive a chip, perform testing, and allow for removal of the chip over and over for numerous chips.

SUMMARY

Conventional testing of burn-in sockets as well as the electrical contacts used in such sockets suffer from various deficiencies. In particular, during manufacture of such sockets, each contact includes a pair of terminal arms that must be inserted and placed into the socket body in a precise and accurate manner. After insertion or mounting of the contact into the socket body, a tail or lead end of the contact remains extending downward from and external to the socket body. This tail or contact lead allows for engagement of various testing equipment substrates used to provide electrical signals to the chips that become mounted into the socket during testing. During socket construction, when mounting large numbers of contacts within a single socket body, it is important that the tail or lead ends of each contact are precisely and property aligned with each other to conform to the substrate to which the socket will be connected during IC chip testing. Accordingly, mounting or placement of the contact into the socket body is a precision process that must result in correct alignment of a tail end or lead end of the contact that mates with substrates of the testing equipment.

FIG. 1 illustrates an example conventional socket apparatus 100 that includes an array of conventional contacts 110 mounted therein. FIG. 2 illustrates a side view of the same conventional socket apparatus 100. The view in FIG. 1 shows an underside view of a body 101 of the socket 100 and thus only the tail ends 112 of each contact 110 are visible from the bottom of the socket 100. FIG. 2 shows the side view in which each contact 110 extends through the body 101 of the socket 100 and contact fingers 114 are visible extending slightly above a top surface of the body 101 of the socket 100. The socket 100 further includes a movable top portion 106 that is biased upwards and away from the body portion 101 by springs 109.

FIG. 3 illustrates only the base portion 101 of the socket 100 as viewed from its underside. Note the array of contact cavities 108 that each provides slots for fingers 114 of a given contact 110.

FIGS. 4A and 4B illustrate front and back views of a conventional contact 110 as it exists prior to being inserted into and through a contact cavity 108 molded or formed within the body 101 of the socket 100. The conventional contact 110 includes a lead or tail end 112, a mounting portion 113, and first and second contact fingers 114-1 and 114-2. Notice that the first contact finger 114-1 includes a slight bend 115 near where it connects to a sidewall of the mounting portion 113. Each contact 110 is constructed by stamping, etching, cutting or otherwise forming a flat sheet of metal into the outline of the contact. After stamping, sidewalls of the mounting portion 113 and the contact fingers 114-1 and 114-2 that extend therefrom are folded ninety degrees with respect to the center sidewall of the mounting portion 113 from which the lead 112 extends. This provides for the 3-dimensional shape of the conventional contact 110 as shown in FIGS. 4A and 4B.

During construction of the socket 100 shown in FIGS. 1 and 2, fingers 114 of each contact 110 are inserted from the bottom side of the socket body 101 (as shown in FIG. 3), into respective contact cavities that are defined within the body 101 of the socket 100. During insertion, each finger 114 passes through a respective finger slot in the socket body 101 as shown in FIG. 3. After all contacts 110 are inserted into the body 101, an alignment base plate 107 (see FIG. 1) is placed over the array of contact leads to maintain each contact 110 in proper alignment with the others. Upon full insertion, the mounting portion 113 of the contact 110 resides within and presses firmly against sides or interior walls of a contact cavity defined within the base plate 107. That is, after the contact fingers 114 are inserted into body 101, the base layer 107 is slipped over the lead ends 112 up to mounting portions 113 of each contact 110. The base plate provides a respective square shaped contact cavity directly adjacent the mounting portion 113 of each contact. The sidewalls of the mounting portion 113 press against adjacent sidewalls of the cavity in the base portion. All contacts 110 are inserted in this manner to form the array of contacts for the socket 100.

Referring briefly back to FIG. 2, when a top portion 106 of the socket 100 is in the upward position as illustrated, the fingers 114 of the contacts 110 are biased towards each other and remain in a closed position. When a chip is to be inserted into the socket 100, the top portion 106 of the socket can be depressed (against the force of the springs 109) towards the body 101 of the socket 100. Doing so causes a cam arm 111 of the top portion 106 to engage with a cam 116 formed as part of a sliding portion 117, thus sliding the sliding portion 117 to the left. When the sliding portion 117 moves to the left, armatures (not shown) on the sliding portion 107 engage with each movable contact finger 114-1 of each contact 110 to cause such contact finger 114-1 to move away from the other finger 114-2, thus opening or separating the contact finger 114-1 from the contact finger 114-2. Insertion of an IC chip (not shown in figures) into the socket 100 thus causes the sliding portion 107 to concurrently open all fingers 114 at the same time to allow for a zero insertion force fit of respective terminals of the IC chip into respective pairs of now open fingers 114. When the IC chip is in place, the chip is release and the pressure on the top portion 106 is also released and the sliding portion 107 returns to the right and causes the fingers 114 for each contact 110 to close and grab onto the terminals of the IC chip to form a snug electrical connection for each IC terminal, ball or lead to a respective contact 110.

During manufacturing each contact finger 114 of the contact 110 must be accurately aligned and then inserted into a respective finger slot formed in the contact cavity 108 within the body 101 of the socket 100. The finger slots 108 for each contact finger 114 are part of the contact cavity that is integrally formed in the body 101 of the socket 100. Once each contact 110 is fully inserted into the body 101, to keep the lead ends 112 of each contact 110 properly aligned, conventional sockets 100 include the alignment plate 107 that inserts over the lead ends of each contact 110 in the array of contacts to properly maintain alignment of each contact lead 112. The alignment plate 107 maintains proper alignment of each contact 110 and counteracts forces exerted on the contact 110 during insertion and during normal opening and closing of contact fingers.

In contrast to conventional socket and contact designs, embodiments disclosed herein provide for a contact and body portion of a socket that does not require a separate alignment plate 107 to be used to maintain alignment of each contact in a socket. By not requiring the alignment plate, cost per part and assembly time are reduced. Embodiments disclosed herein include a socket having a base portion defining an array of contact cavities. The base portion includes a top side and a bottom side and a plurality of ribs extending from the bottom side. Each rib defines at least one sidewall that engages with an anchor of a contact to securely mount the contact within a contact cavity that receives the contact. A plurality of newly designed contacts are inserted into the array of contact cavities defined in the base portion. Each contact includes a mounting portion preferably having a first anchor and a second anchor extending from the mounting portion. The anchors are operable to engage the ribs of the base portion to securely mount the contact. The first anchor provides a first anchor force for the contact to the base portion that is substantially greater than a second anchor force provided by the second anchor to the base portion.

Embodiments disclosed herein also include a newly designed contact and socket body for use within a socket. The newly designed contact includes at least one terminal arm, a lead portion and a mounting portion coupling the terminal arm(s) to the lead. A first anchor and a second anchor extend from the mounting portion and are operable to engage a mounting surface to securely mount the contact as it is mounted in a contact cavity of the body of a socket. During installation of a contact in accordance with embodiments described herein, the first and second anchors for a given contact engage with the ribs of the socket body into which the contact is being installed to provide an asymmetrical mounting or gripping force for the contact. The anchors extend from the mounting portion and are operable to engage mounting surfaces or sidewalls of the ribs to securely mount the contact within its cavity. The first anchor provides a first anchor force for the contact that is substantially greater than a second anchor force provided by the second anchor. In one configuration, the first anchor and the second anchor extend asymmetrically with respect to each other from outer planes defined by opposite sidewalls of the mounting portion of the contact.

Other embodiments include a socket apparatus comprising a base portion defining an array of contact cavities and a plurality of contacts inserted into the array of contact cavities defined in the base portion. Each contact includes a mounting portion having a first anchor and a second anchor extending from the mounting portion and operable to engage a mounting surface of the base portion to securely mount the contact. The first anchor provides a first anchor force for the contact to the base portion that is substantially greater than a second anchor force provided by the second anchor to the base portion. The base portion includes a top side and a bottom side and a plurality of ribs extending from the bottom side. Each rib defines at least one sidewall that engages with an anchor of a contact to securely mount the contact within a contact cavity that receives the contact. The various variations of the contact as explained herein may be employed in the socket embodiment disclosed herein.

The embodiments disclosed herein, may be employed in devices such as those manufactured by Sensata Technologies, Inc. of Attleboro, Mass., U.S.A.

BRIEF DESCRIPTION OF THE DRAWINGS

The foregoing will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Embodiments of the invention disclosed herein provide for a novel socket and contact for use in IC testing that provides secure mounting or fitment of contacts into the socket without a requirement for an alignment plate. From the discussion above of the conventional sockets, an alignment plate is required to be inserted on the underside of a conventional socket body to maintain alignment of the contact leads. The embodiments disclosed herein include a newly designed socket body that includes mounting ribs that extend below a lower surface of the socket body to provide additional contact support. Additionally, embodiments include a newly designed contact that includes a mounting area with protrusions or anchors that allow the mounting area to firmly grip the ribbed sidewalls of the socket body to firmly hold the newly designed contact into the cavity without requiring an alignment plate. The anchors provide a gripping force to more securely adhere the mounting portion of the contact into its contact cavity so that insertion forces and rotational forces or moments experienced by the contact during insertion are properly counteracted/compensated for to maintain alignment of the lead portions of the contact. In particular, one side of the mounting portion of a contact has an anchor that provides a stronger anchor force than that of the opposing side, thus providing an asymmetrical anchoring force. This additional anchor force provided on one side of the mounting portion of the contact operates to counteract additional forces experienced on that side of the contact during insertion of the contact into the socket body. The additional forces are caused by the preloading of the movable contact arm to normally be biased in contact with the other contact arm.

Figure 1:
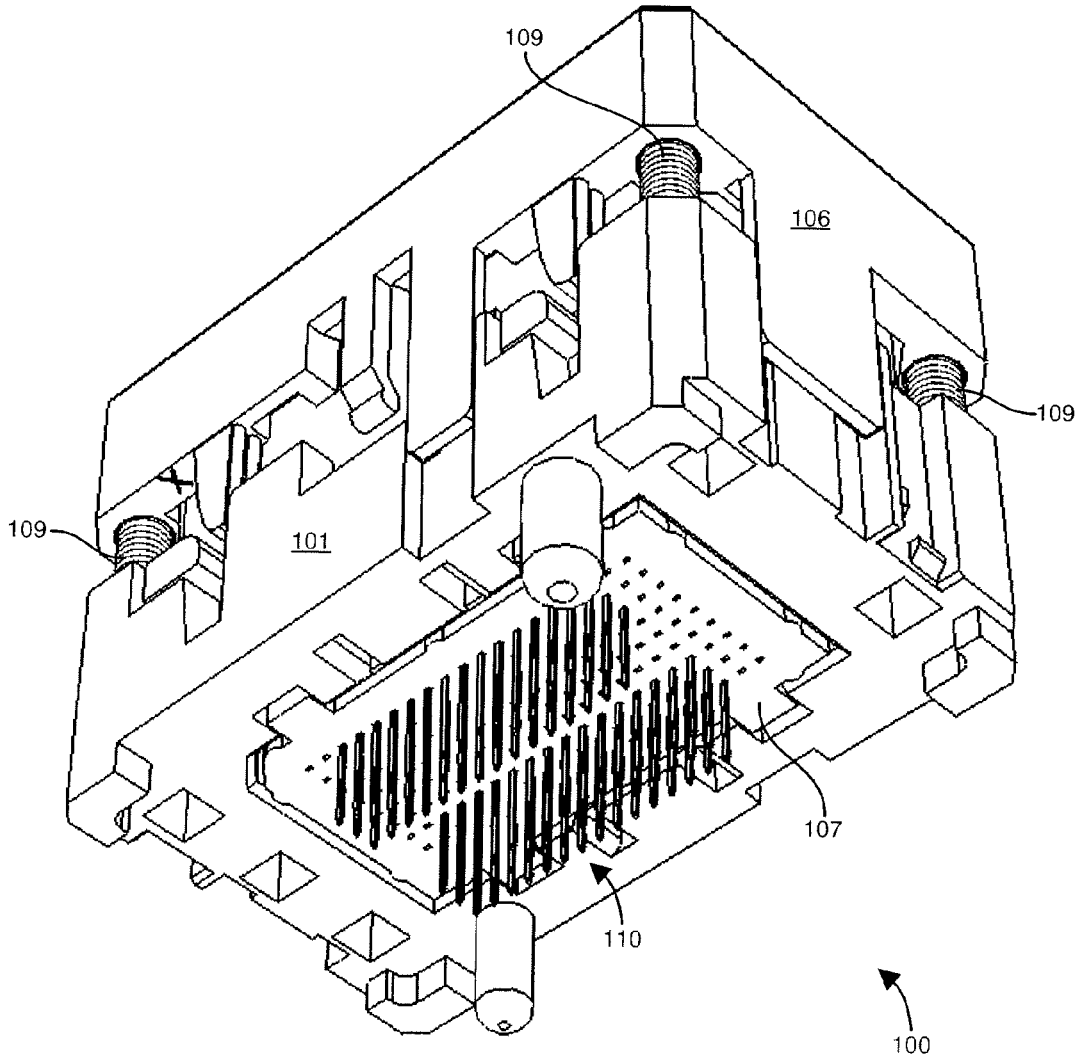
PRIOR ART FIG. 1
FIG. 1 illustrates a view of a conventional socket apparatus that includes an alignment layer.
Figure 2:
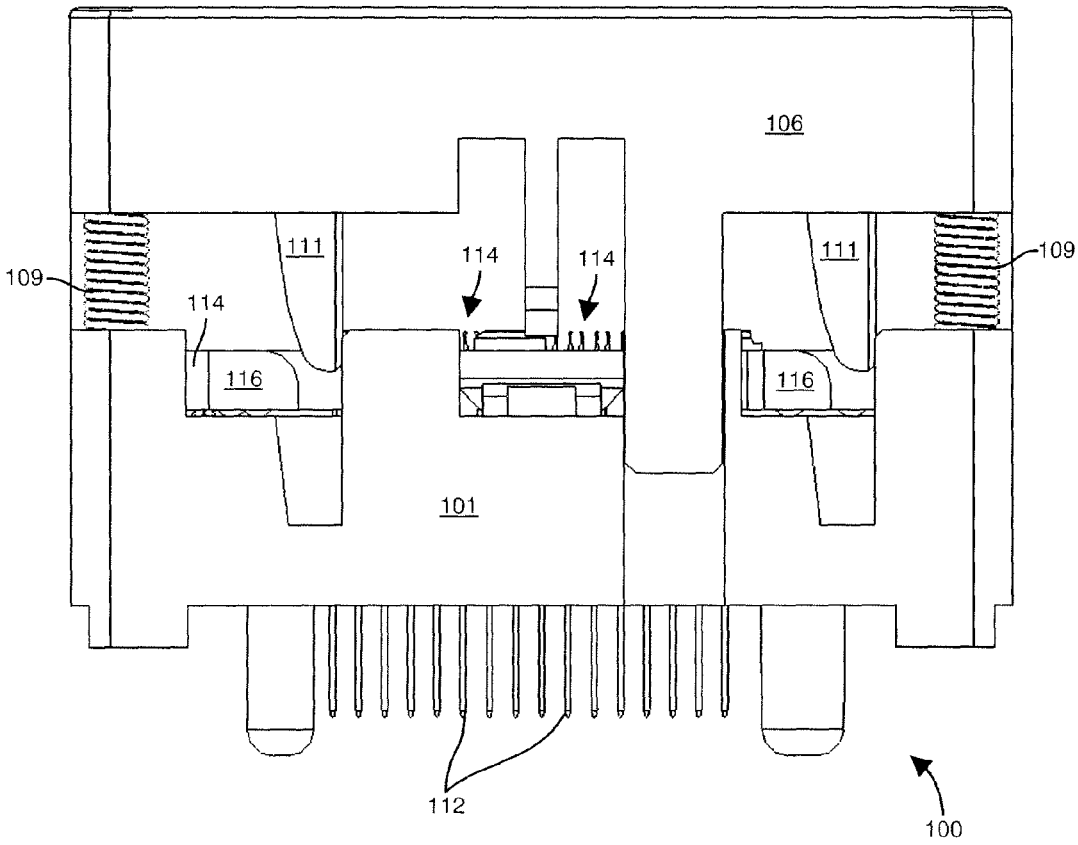
PRIOR ART FIG. 2
FIG. 2 illustrates a side view of a conventional socket apparatus.
Figure 3:
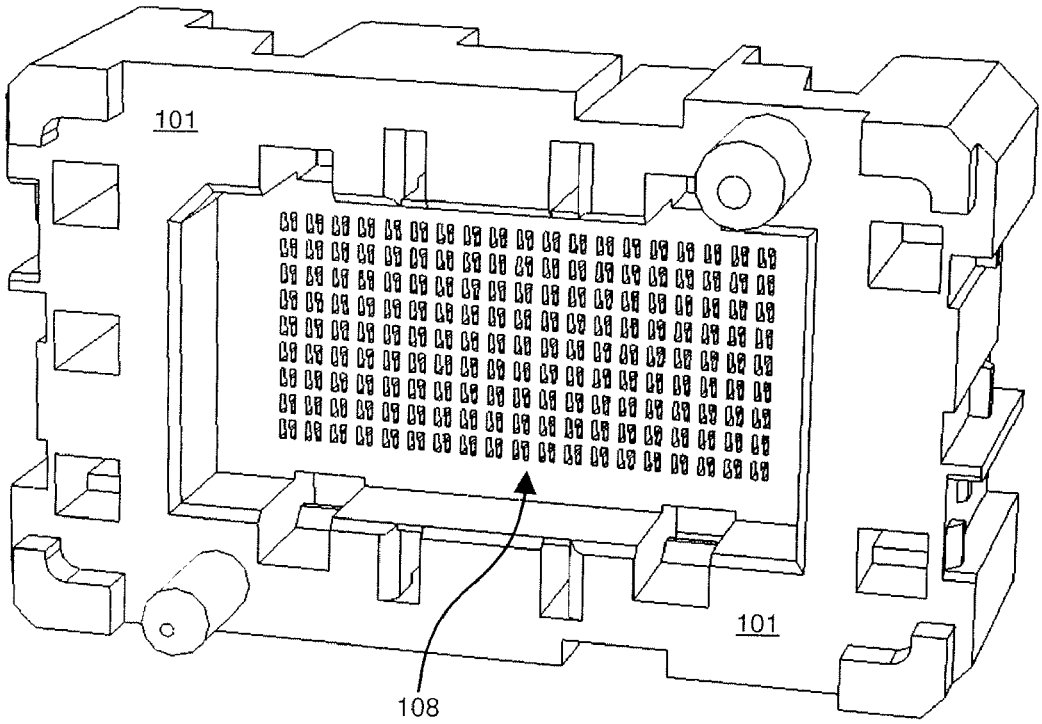
FIG. 3 illustrates a view of a conventional base portion of the conventional socket apparatus in FIGS. 1 and 2.
Figure 4A:
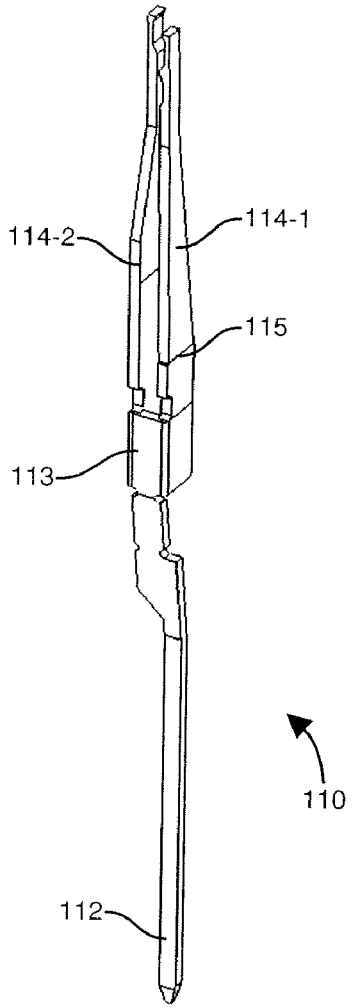
PRIOR ART FIG. 4A
FIGS. 4A and 4B illustrate a conventional contact used in the socket apparatus shown in FIGS. 1 through 3.
Figure 4B:
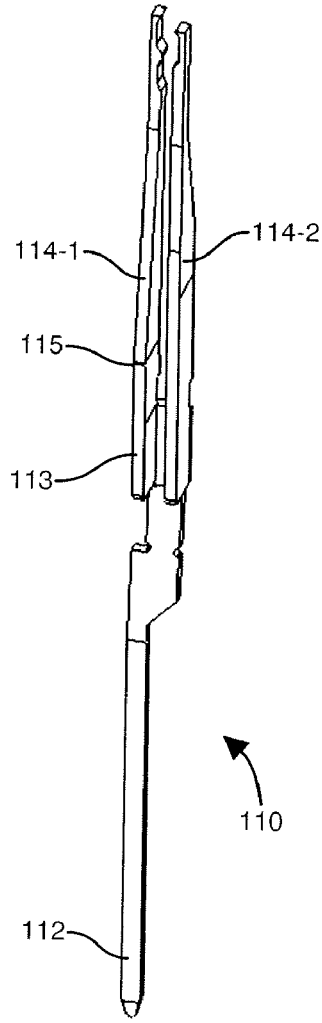
PRIOR ART FIG. 4B
Figure 5:
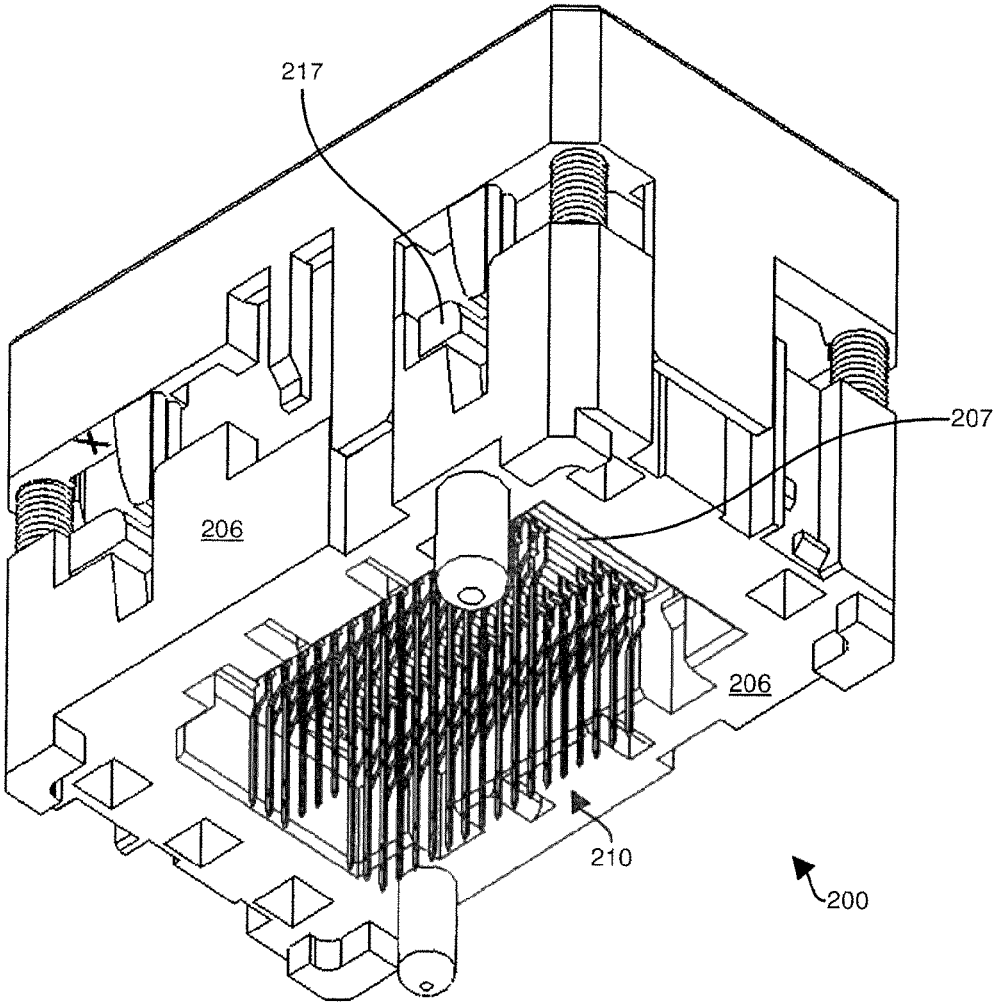
FIG. 5 illustrates a novel socket apparatus configured in accordance with embodiments disclosed herein.

FIG. 5 illustrates a socket 200 configured in accordance with one example embodiment. The new socket 200 provides for a socket body or base portion 206 that that includes mounting ribs 207 that extend from an underside of the socket base 206. The base portion 206 also defining an array of contact cavities that receive the fingers of each contact. A plurality of contacts 210 are inserted into the array of contact cavities defined in the base portion. The mounting ribs 207 engage with mounting portions of contacts 210 to securely mount the contacts 210 in place without requiring an alignment plate.

Figure 6:
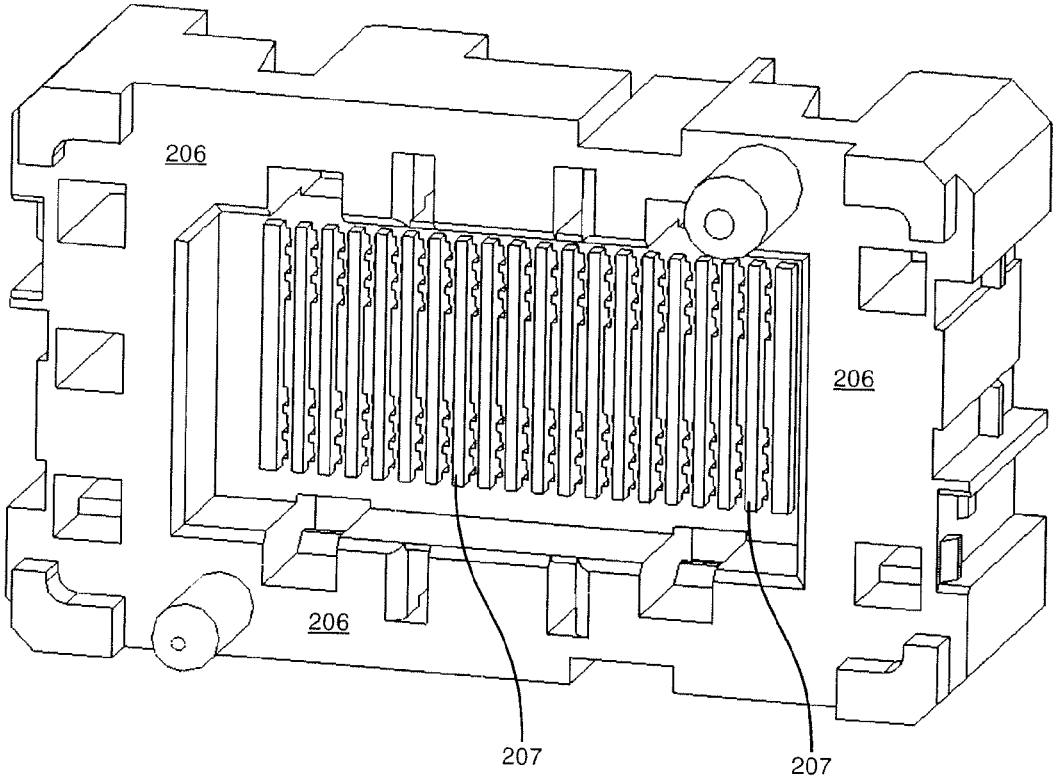
FIG. 6 illustrates a bottom view of a novel base portion of the socket apparatus shown in FIG. 6 in accordance with embodiments disclosed herein.

FIG. 6 shows the base portion 206 and mounting ribs 207 in more detail. The base portion includes a top side and a bottom side (labeled as 206 in FIG. 6) and a plurality of ribs 207 extending from the bottom side. Each rib defines at least one sidewall that engages with an anchor of a contact 210 as will be explained to securely mount the contact within a contact cavity that receives the contact. The mounting ribs 207 in combination with a new contact design (to be explained shortly) enable each contact 210 to firmly and accurately maintain proper alignment without requiring the use of the alignment plate 107 as is required in the prior art socket and contact designs as shown in FIGS. 1 through 4.

Figure 7A:
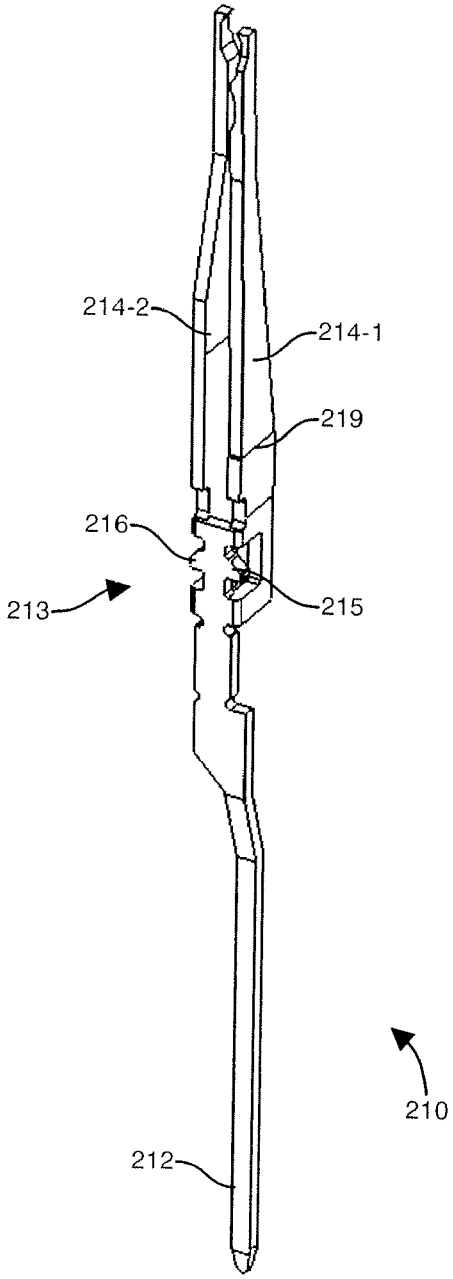
FIGS. 7A and 7B illustrate a novel contact used in the socket in accordance with embodiments disclosed herein.
Figure 7B:
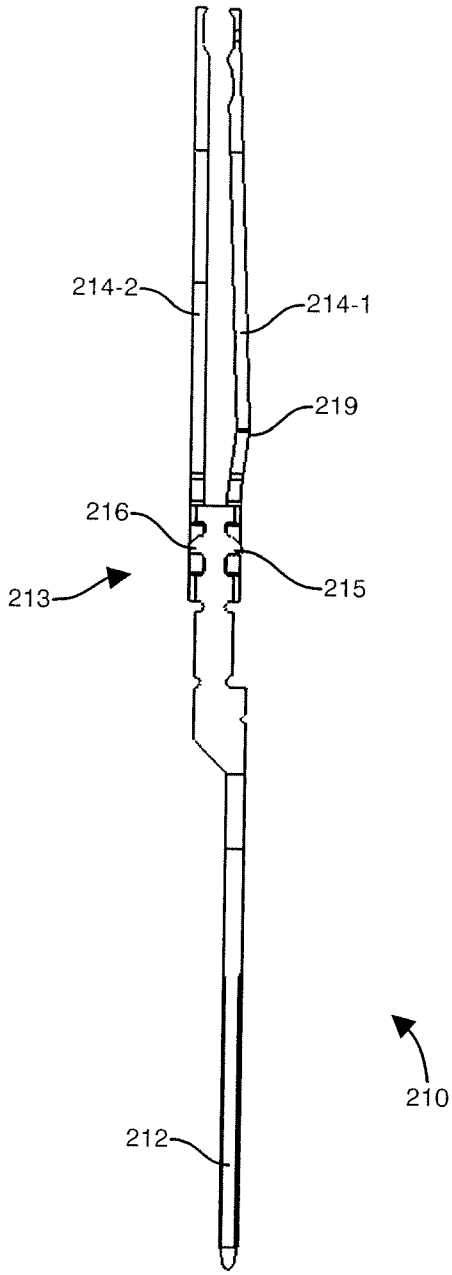

FIGS. 7A and 7B illustrate two views of a newly designed contact 210 configured in accordance with one example embodiment as disclosed herein. The contact 210 shown in FIGS. 7A and 7B is for use with the new socket 200 and socket body 206 as shown in FIGS. 5 and 6. In FIGS. 7A and 7B, the contact 210 includes at least one terminal arm (two in this example, a first or movable terminal arm 214-1 and second or stationary terminal arm 214-2), a lead portion 212, and a mounting portion 223 that couple the terminal arm(s) 214 to the lead 212. Note that terminal arm 214-1 includes a slight deformation or bend 219 to bias the terminal arm 214-1 towards terminal arm 214-2. One or more sidewalls of the mounting portion 213 include anchors 215, 216 to anchor and secure the mounting portion 213 to ribs 207 of the socket body 206 in between which the contact 210 is inserted.

In particular, in this example embodiment, a first anchor 215 and a second anchor 216 extend from the mounting portion 213 of the contact 210 and are operable to engage a mounting surface (i.e. the ribs 207 on the underside of the socket body 206) to securely mount the contact 210 in place. These anchors can by way of example be flanges as shown in FIGS. 7A and 7B. The first anchor 215 provides a first anchor force (i.e. into the rib 207) for the contact 210 that is substantially greater than a second anchor force provided by the second anchor 216. In this design, the first anchor 215 and the second anchor 216 are formed as part of a connecting sidewall 223 that couples sidewalls 221 and 222 of the mounting portion 213. Each anchor 215 and 216 extends asymmetrically with respect to each other from outer planes defined by these opposite sidewalls 221, 222 of the mounting portion 213.

Figure 8:
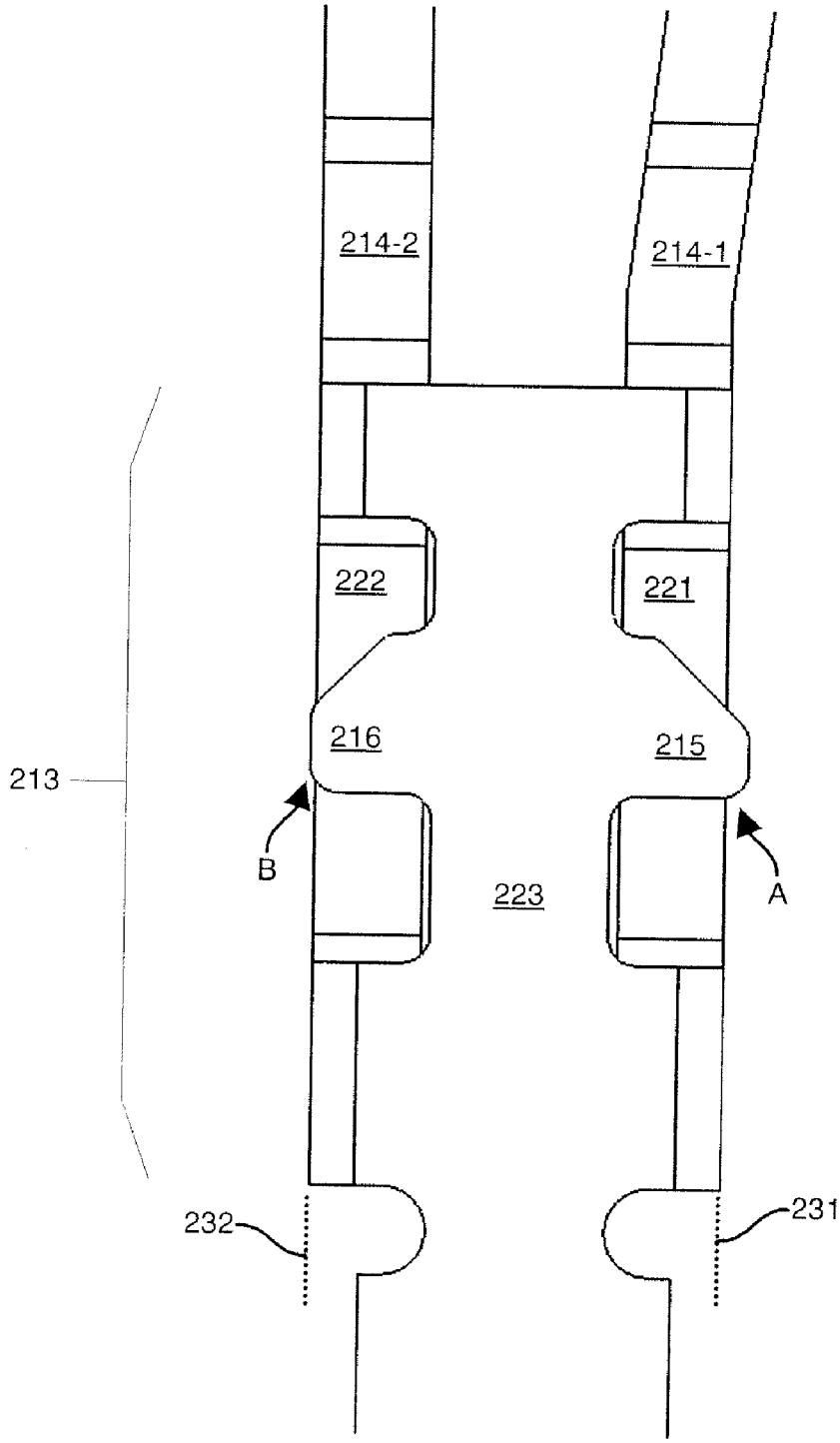
FIG. 8 illustrates a close-up view of a mounting portion of the contact shown in FIG. 7B.

FIG. 8 illustrates a close up view of the design of the mounting portion 213 of a contact in accordance with one example embodiment of the contact 210 as shown in FIG. 7B. In FIG. 8, the mounting portion 213 includes a first sidewall 221 defining a first outer plane 231 and a second sidewall 222 defining a second outer plane 232 (the planes 231 and 232 are shown by dotted lines below the bottom edges of the first and second sidewalls 221, 222). The first terminal arm 214-1 extends from the first sidewall 221 and the second terminal arm 214-2 extends from the second sidewall 222. As shown, the first anchor 215 extends outwards a total distance A from the first outer plane 231 defined by the first sidewall 221 and the second anchor 216 extends outwards a total distance B from the second outer plane 232 defined by the second sidewall 222. The distance A is greater than the distance B—that is, the first anchor 215 protrudes out from the sidewall 221 more than the second anchor 216 protrudes from the sidewall 222. It is to be noted that distance B for the second anchor can be as small as essentially zero so long as dimension A is significantly large so as to produce the desired larger first anchor force as compared to the second anchor force. Typical values for distance A range between 0.015 mm and 0.1 mm.

Figure 9:
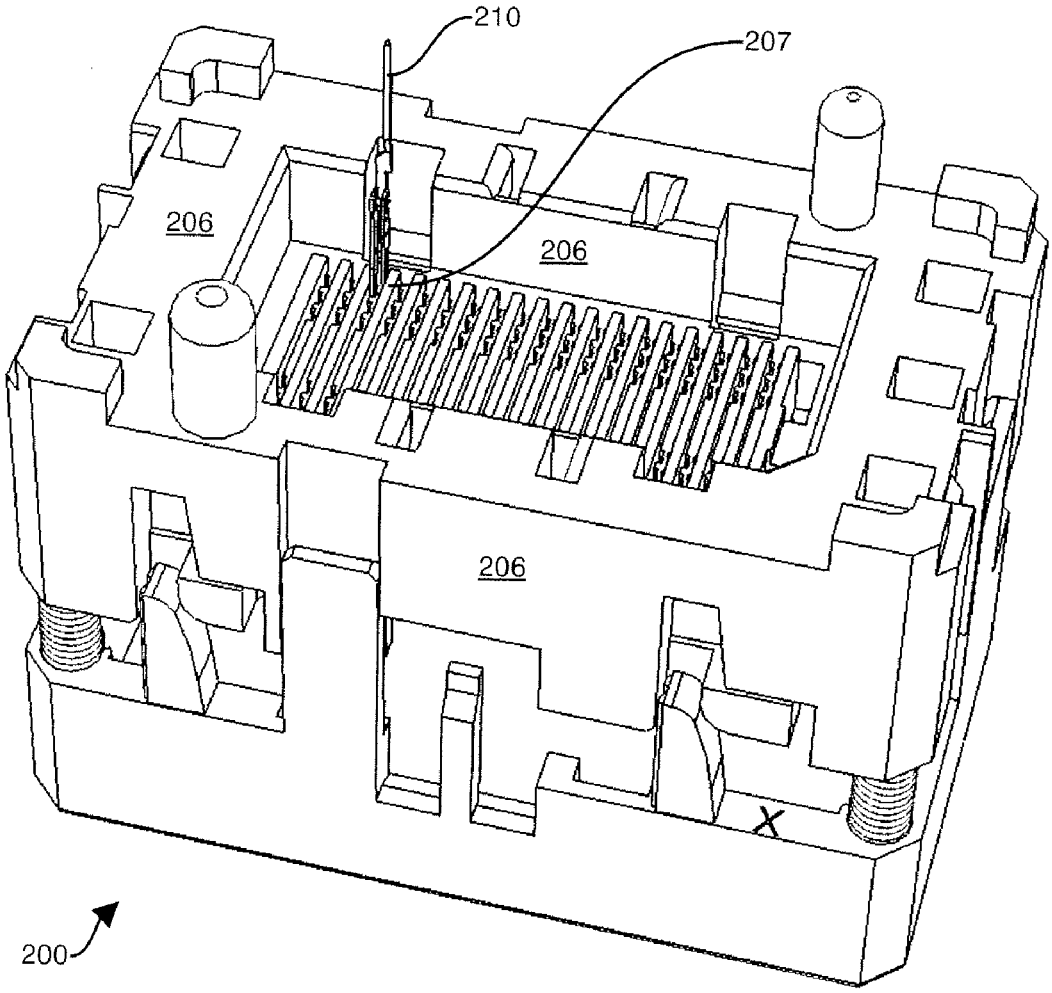
FIG. 9 illustrates insertion of a contact into a ribbed socket body in accordance with embodiments disclosed herein.
Figure 10:
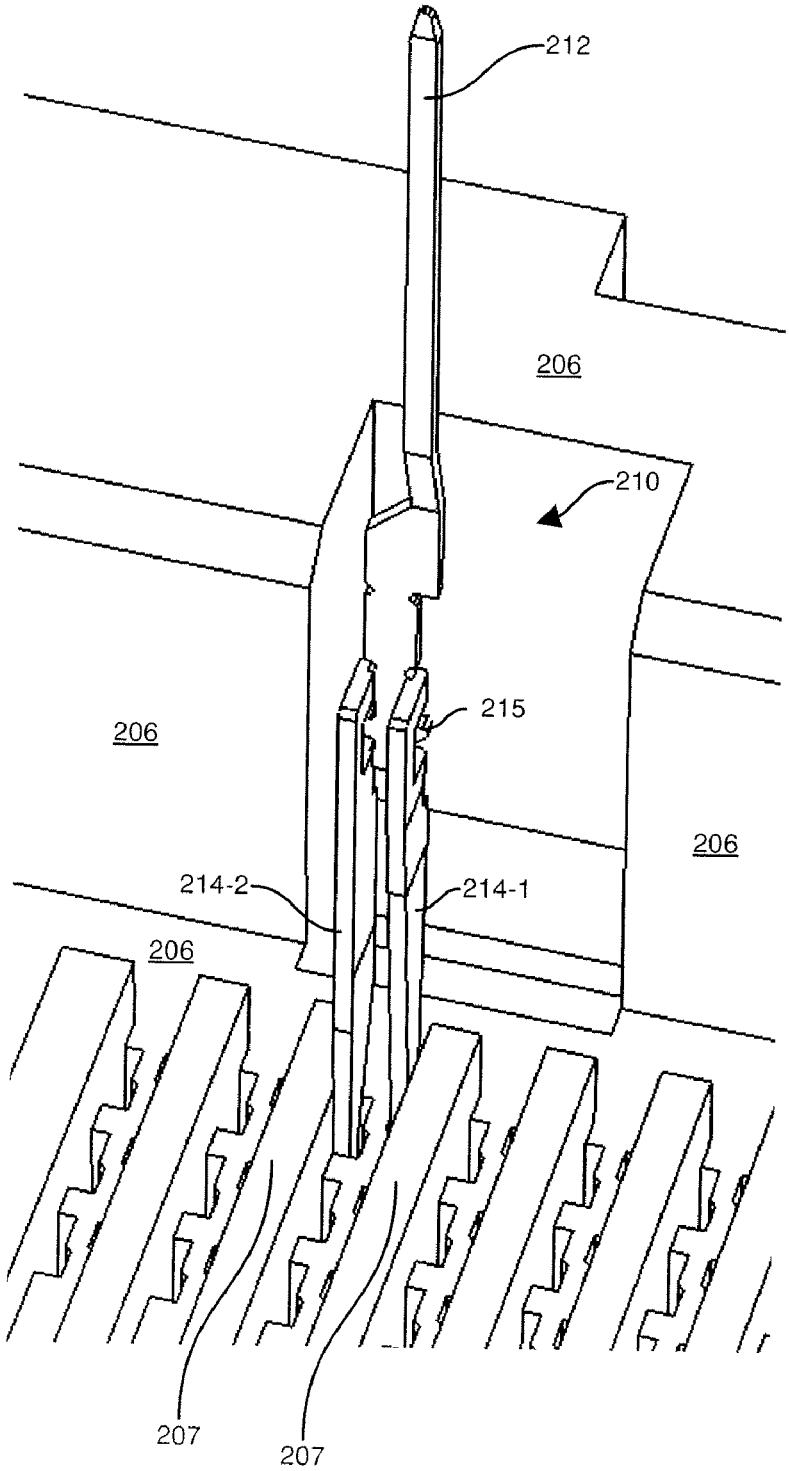
FIG. 10 illustrates a close up view of insertion of a contact into a ribbed socket body in accordance with embodiments disclosed herein.

FIGS. 9 and 10 show an example of a contact 210 being inserted into a socket cavity defined by the ribs 207 on the underside of the socket body 206. As the contact 210 is inserted and press-fit into a socket body 206, each of the first and second anchors 215, 216 (shaped as flanges in this example) engages respective sidewalls of ribs 207 of the socket body 206 and bites into or grips the sidewalls of ribs 207. Since the anchor 215 is larger and extends out from the sidewall 221 more than the anchor 216 extend form the sidewall 222, the first anchor 215 provides more gripping and mounting force than the second anchor 216.

During normal operation of the socket 200, as IC chips are inserted and removed from the socket 200, the first terminal arm 214-1 is operable to exert a first moment force on the contact 210 that is greater than a second moment force exerted on the contact 210 by the second terminal arm 214-2 due to preload (in this case the bend 219) in the first contact 214-1. The first anchor 215 is able to better counter greater rotational or other moments experienced on the side of the contact 210 associated with the preload of the bent first terminal arm 214-1. In particular, the first anchor force provides a substantially greater force to counteract the larger first moment force experienced during insertion of the contact 210. Specifically, during insertion of the contact 210 into the socket body 206, the first terminal arm 214-1 is temporarily flattened as the bend 219 slides through its respective slot in the body 206. As a result of this flattening of the first terminal arm 214-1, during insertion the terminal arm 214-1, a preload is created, exerting a larger first moment force or back force or resistance on the contact as a result of being non-planar.

Figure 11:
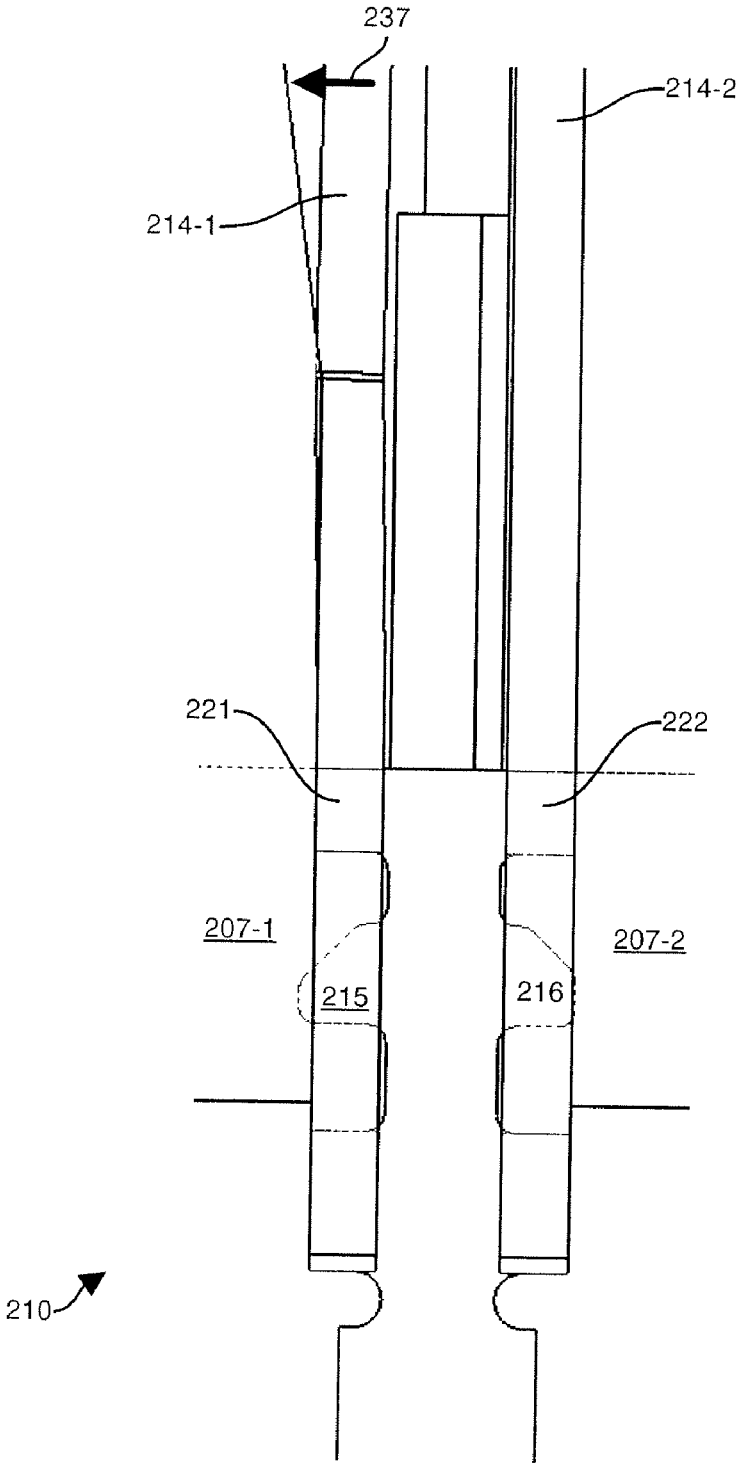
FIG. 11 illustrates a fully inserted contact that has been inserted into a socket body in accordance with embodiments disclosed herein.

FIG. 11 (reversed view of FIG. 8) illustrates an example of the contact 210 when fully inserted into the body 206 of a socket 200. As shown, the first anchor 215 is embedded into the sidewall of the rib 207-1 a greater distance than the second anchor 216 is embedded into the sidewall of the rib 207-2. The first anchor 215 thus provides a greater holding force then the second anchor 216. During operation of the socket 200, as chips are inserted and removed from the socket 200, the first terminal arm 214-1 is repeatedly moved in the direction of arrow 237 (by the sliding portion 217 in FIG. 5) in order to open and close the fingers 214. Accordingly, the first anchor 215 is sized larger to provide a stronger anchor force on side 221 of the contact 210 to counteract the preload force experienced on the sidewall 221 when contacts 210 is mounted in socket 200.

In the examples shown in FIGS. 7 through 10, the mounting portion 213 includes a connecting sidewall 223 that orthogonally connects the first sidewall 221 to the second sidewall 222. The first anchor 215 and the second anchor 216 are formed as respective first and second flanges that are integrally formed as part of the connecting sidewall 223. The first flange 215 extends outwards from the first outer plane 231 of the first sidewall a greater distance (A) than the second flange 216 that extends outwards a distance (B) from the second outer plane 232 of the second sidewall 222.

Figure 12:
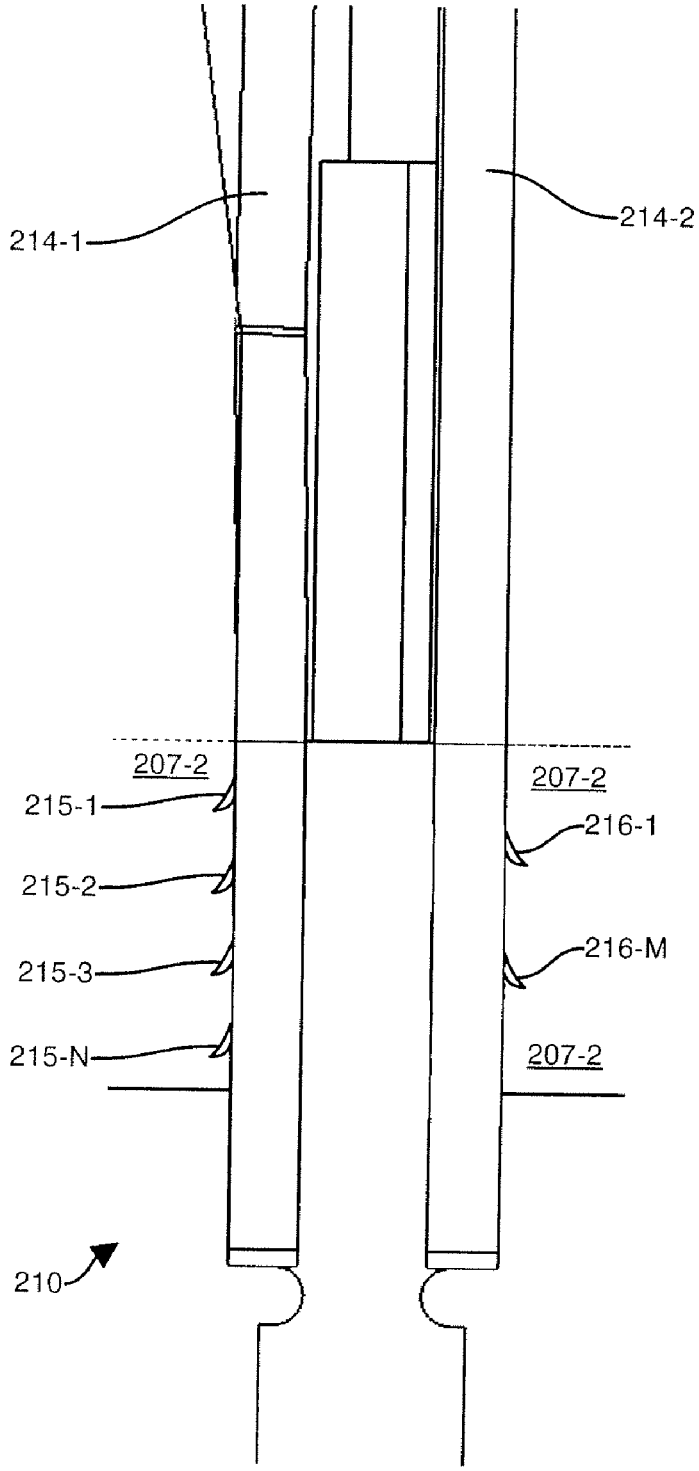
FIG. 12 illustrates an alternative configuration of barbed anchors on a contact in accordance with embodiments disclosed herein.

FIG. 12 illustrates an alternative embodiment of a contact 210 in which the first anchor is a series of first anchors 215-1 through 215-N defined in the first sidewall 221 and that extend from the first sidewall 221 to collectively provide the first anchor force for the contact 210. The second anchor is a series of second anchors 216-1 through 216-M defined in the second sidewall 22 and that extend from the second sidewall 222 to collectively provide the second anchor force that is less than the first anchor force. In this example embodiment, the series of first anchors 215 and the series of second anchors 216 are barbs that extend outwards from opposite sidewalls of the mounting portion 213. In this example, the series of first anchors 215-1 through 215-N is greater in number (N) of anchors than the series of second anchors 216-1 through 216-M (i.e. N>M). In an alternative embodiment, the series of first anchors 215 may be greater in size of anchors than the series of second anchors 216.

Although the invention has been described with regards to specific preferred embodiments thereof, variations and modifications will become apparent to those of ordinary skill in the art. It is therefore, the intent that the appended claims be interpreted as broadly as possible in view of the prior art to include such variations and modifications.

What is claimed is:

1. A contact comprising:

at least one terminal arm;

a lead portion;

a mounting portion coupling the at least one terminal arm to the lead portion, said mounting portion haying a central axis and including a first sidewall which defines a first outer plane and a second sidewall which defines a second outer plane which is parallel to the first outer plane and said central axis;

a first anchor and a second anchor extending from the mounting portion in opposite directions and operable to engage a mounting surface to securely mount the contact, the first anchor extending outward from the first outer plane a distance greater than a distance of the second anchor extending outward from the second outer plane thereby providing a first anchor force for the contact that is greater than a second anchor force provided by the second anchor.

2. The contact of claim 1 wherein the first anchor and the second anchor extend asymmetrically with respect to each other from outer planes defined by a first and a second opposite sidewall of the mounting portion.

3. The contact of claim 2 wherein the at least one terminal arm includes a first terminal arm that extends from the first sidewall and a second terminal arm that extends from the second sidewall; and wherein the first terminal arm is operable to exert a first moment force on the contact that is greater than a second moment force exerted on the contact by the second terminal arm, the first anchor force providing a substantially greater first anchor force to counteract the first moment force.

4. The contact of claim 3 wherein the first terminal arm is non-planar and wherein the second terminal arm is planar and wherein the first terminal arm exerts the first moment force on the contact as a result of being non-planar.

5. The contact of claim 2 wherein the mounting portion includes:

a connecting sidewall that connects the first sidewall to the second sidewall; and wherein the first anchor and the second anchor are formed as respective first and second flanges that are integrally formed as part of the connecting sidewall; and wherein the first flange extends outwards from the first outer plane of the first sidewall a greater distance that the second flange extends outwards form the second outer plane of the second sidewall.

6. The contact of claim 1 wherein the first anchor is a series of first anchors defined in the first sidewall and that extend from the first sidewall to collectively provide the first anchor force and wherein the second anchor is a series of second anchors defined in the second sidewall and that extend from the second sidewall to collectively provide the second anchor force that is less than the first anchor force.

7. The contact of claim 6 wherein the series of first anchors is greater in number of anchors than the series of second anchors.

8. The contact of claim 6 wherein the series of first anchors is greater in size of anchors than the series of second anchors.

9. The contact of claim 6 wherein the series of first anchors and the series of second anchors are barbs that extend in from opposite sidewalls of the mounting portion.

10. A socket apparatus comprising:

a base portion defining an array of contact cavities;

a plurality of contacts inserted into the array of contact cavities defined in the base portion, each contact including a mounting portion, said mounting portion haying a central axis and including a first sidewall which defines a first outer plane and a second sidewall which defines a second plane which is parallel to the first outer plane and said central axis;

a first anchor and a second anchor extending from the mounting portion in opposite directions and operable to engage a mounting surface of the base portion to securely mount the contact, the first anchor extending outward from the first outer plane a distance greater than the distance of the second anchor extending outward from the second outer plane thereby providing a first anchor force for the contact to the base portion that is greater than a second anchor force provided by the second anchor to the base portion.

11. The socket apparatus of claim 10 wherein the base portion includes a top side and a bottom side and a plurality of ribs extending from the bottom side, each rib defining at least one sidewall portion adjacent one of said first and second sidewalls that engages with an anchor of said first and second anchors of a contact of said plurality of contacts to securely mount the contact within a contact cavity that receives the contact.

12. The socket apparatus of claim 11 wherein the first anchor and the second anchor extend asymmetrically with respect to each other into ribs of the base portion from outer planes defined by opposite sidewalls of the mounting portion.

13. The socket apparatus of claim 12 wherein the at least one terminal arm includes a first terminal arm that extends from the first sidewall and a second terminal arm that extends from the second sidewall; and wherein the first terminal arm is operable to exert a first moment force on the contact that is greater than a second moment force exerted on the contact by the second terminal arm, the first anchor force providing a substantially greater first anchor force into the first rib to counteract the first moment force.

14. The socket apparatus of claim 11 wherein the mounting portion includes:

a connecting sidewall that connects the first sidewall to the second sidewall; and wherein the first anchor and the second anchor are formed as respective first and second flanges that are integrally formed as part of the connecting sidewall; and wherein the first flange extends outwards from the first outer plane of the first sidewall a greater distance than the second flange extends outwards form the second outer plane of the second sidewall.

15. The socket apparatus of claim 11 wherein the first anchor is a series of first anchors defined in the first sidewall and that extend from the first sidewall into a first rib of the base portion to collectively provide the first anchor force and wherein the second anchor is a series of second anchors defined in the second sidewall and that extend from the second sidewall into a second rib of the base portion to collectively provide the second anchor force that is less than the first anchor force.

16. The socket apparatus of claim 15 wherein the series of first anchors is greater in number of anchors than the series of second anchors.

17. The socket apparatus of claim 15 wherein the series of first anchors is greater in size of anchors than the series of second anchors.

18. The socket apparatus of claim 15 wherein the series of first anchors and the series of second anchors are barbs that extend in from opposite sidewalls of the mounting portion.

* * * * *